US006206647B1

(12) United States Patent
Van Baar

(10) Patent No.: US 6,206,647 B1
(45) Date of Patent: Mar. 27, 2001

(54) WASTE WATER DISPOSAL SYSTEM

(75) Inventor: Jacobus Eldert Maria Van Baar, Bergen (NL)

(73) Assignee: Intelligent Environmental Systems, B.V. (NL)

( * ) Notice: Subject to any disclaimer, the term of this patent is extended or adjusted under 35 U.S.C. 154(b) by 0 days.

(21) Appl. No.: 09/284,215

(22) PCT Filed: Oct. 10, 1997

(86) PCT No.: PCT/NL97/00568

§ 371 Date: Apr. 7, 1999

§ 102(e) Date: Apr. 7, 1999

(87) PCT Pub. No.: WO98/15694

PCT Pub. Date: Apr. 16, 1998

(30) Foreign Application Priority Data

Oct. 10, 1996 (NL) ..... 1004245

(51) Int. Cl.[7] ..... F04F 1/10
(52) U.S. Cl. ..... 417/120; 129/130
(58) Field of Search ..... 417/120, 129, 417/130

(56) References Cited

U.S. PATENT DOCUMENTS

| | | | | |
|---|---|---|---|---|
| 2,180,274 | * | 11/1939 | Bentley | 417/120 |
| 2,300,039 | * | 10/1942 | Yeomans et al. | 417/120 |
| 2,383,834 | * | 8/1945 | Yeomans | 417/129 X |
| 2,669,941 | * | 2/1954 | Stafford | 417/138 X |
| 2,817,299 | * | 12/1957 | Weis | 417/120 |
| 2,899,908 | * | 8/1959 | Nemecsek | 417/120 |
| 3,049,489 | * | 8/1962 | Ciabattari | 417/120 X |
| 3,253,547 | * | 5/1966 | Weis | 417/120 |
| 4,184,506 | | 1/1980 | Varis et al. . | |
| 5,449,016 | | 9/1995 | Van Baar . | |

FOREIGN PATENT DOCUMENTS

| | | | | |
|---|---|---|---|---|
| 27214 | | 5/1884 | (DE) . | |
| 136603 | * | 12/1919 | (GB) | 417/129 |

OTHER PUBLICATIONS

Keijts, Compressor blasst riool in korte tijd leeg, *Land & Water*, vol. 32, No. 11, Nov. 1992, Amsterdam, pp. 73–75.

* cited by examiner

*Primary Examiner*—Gerald A. Michalsky
(74) *Attorney, Agent, or Firm*—Knoble & Yoshida, LLC

(57) ABSTRACT

A waste water disposal system, in particular a sewer system, including a plurality of collecting containers (3) each divided into a lower space (8) and an upper space (7) separated by a partition (9) including a valve member (10) therein. Sewer connections (1) are connected to the upper spaces (7) of the plurality of collecting containers (3) via supply pipes (2). A discharge pipe (5) is connected to the lower spaces (8) of the collecting containers (3), and a pressure pipe (13) including a compressed air source (16) is connected to the lower spaces (8) of the collecting containers (3). A control system (12) provides for the selective emptying of the collecting containers (3) into the discharge pipe (5) by introducing compressed air into the collecting containers (3) via the pressure pipe (13). The pressure pipe (13) and the discharge pipe (5) are separate pipes, and the collecting containers (3) are interconnected in parallel between the pressure pipe (13) and the discharge pipe (5) to which they are connected via connecting pipes (4,14). The connecting pipe (4) of the discharge pipe (5) of each collecting container (3) runs upwardly from a level near the bottom of the collecting container (3) and is connected to the discharge pipe (5) at a higher level. The compressed air source (16) is connected to provide compressed air simultaneously to all connecting pipes (14) to force waste water through the connecting pipes (4) and the discharge pipe (5).

11 Claims, 2 Drawing Sheets

WASTE WATER DISPOSAL SYSTEM

BACKGROUND OF THE INVENTION

1. Field of the Invention

The present invention relates to a waste water disposal system comprising waste water connections which are connected to a number of collecting spaces via supply pipes, a discharge pipe connected to said collecting spaces, a pressure pipe comprising a compressed air source, which is connected to said collecting spaces, and a control system for selectively emptying said collecting spaces into the discharge pipe by introducing compressed air into the collecting spaces via said pressure pipe.

2. Description of the Prior Art

Such a waste water disposal system configured as a sewage system is for example known from U.S. Pat. No. 5,549,016. With this known sewage system an air compressor is connected to one of the collecting spaces via the pressure pipe. The collecting space is furthermore connected to a next collecting space via the discharge pipe, and in this manner the collecting spaces are connected in series, with the discharge pipe running from the last collecting space in the series connection to a discharge point. When one of the collecting spaces is filled to a predetermined level, the compressor or other compressed air source are turned on and all collecting spaces are emptied.

The object of the invention is to further improve this known waste water disposal system.

SUMMARY OF THE INVENTION

In order to accomplish that objective the waste water disposal system according to the invention is characterized in that the pressure pipe and the discharge pipe are separate pipes, and that the collecting spaces are interconnected in parallel between the pressure pipe and the discharge pipe, to which they are connected via connecting pipes.

As a result of this parallel-connection of the collecting spaces relative to the pressure pipe and the discharge pipe a more reliable system featuring a reduced energy consumption is obtained. Said reliability is achieved in that one collecting space may exhibit a defect when a parallel arrangement is used, whilst it will still be possible in that case to empty the other collecting spaces. The energy consumption can be reduced since it can be arranged that only a collecting space which is filled to said predetermined level will be emptied.

In order to arrange in a simple manner that only one collecting space will be emptied, the invention proposes to incorporate a non-return valve in the connecting pipe between each collecting space and the discharge pipe, which non-return valve closes in the direction of the collecting space. In this manner it is also possible to prevent the occurrence of a pressure loss in the discharge pipe. To that end it is furthermore advantageous that the non-return valves are closed in the position of rest and that they will only open when pressure is supplied from the associated collecting space.

The individual emptying of the collecting spaces can in particular be practically realised when each collecting space has an air valve connected to the control system incorporated in the connecting pipe on the side of the pressure pipe, whilst the control system is arranged for individually operating the various air valves.

It is noted that each collecting space may be fitted with its own air valve, but that is also possible for several collecting spaces to be provided with one common air valve.

Furthermore it is conceivable to maintain a constant overpressure in the pressure pipe, whilst it is also possible to build up pressure in the pressure pipe anew each time a collecting space is to be emptied.

Another advantage of the waste water disposal system according to the invention is that it allows a greater freedom of design. Thus it is no longer necessary to dispose the compressed air source at the beginning of a series arrangement. It is possible to disposed a compressed air source at a random location in the pressure pipe according to the invention, whilst it is also possible to connect several compressed air sources to one pressure pipe. Also the discharge pipe may be provided with a discharge point at a random location, whilst it is also conceivable to provide several discharge points.

The invention will be explained in more detail hereafter with reference to the drawing, which shows a waste water disposal system according to the invention in the form of a sewage system.

DETAILED DESCRIPTION OF THE PREFERRED EMBODIMENTS

Figure 1:
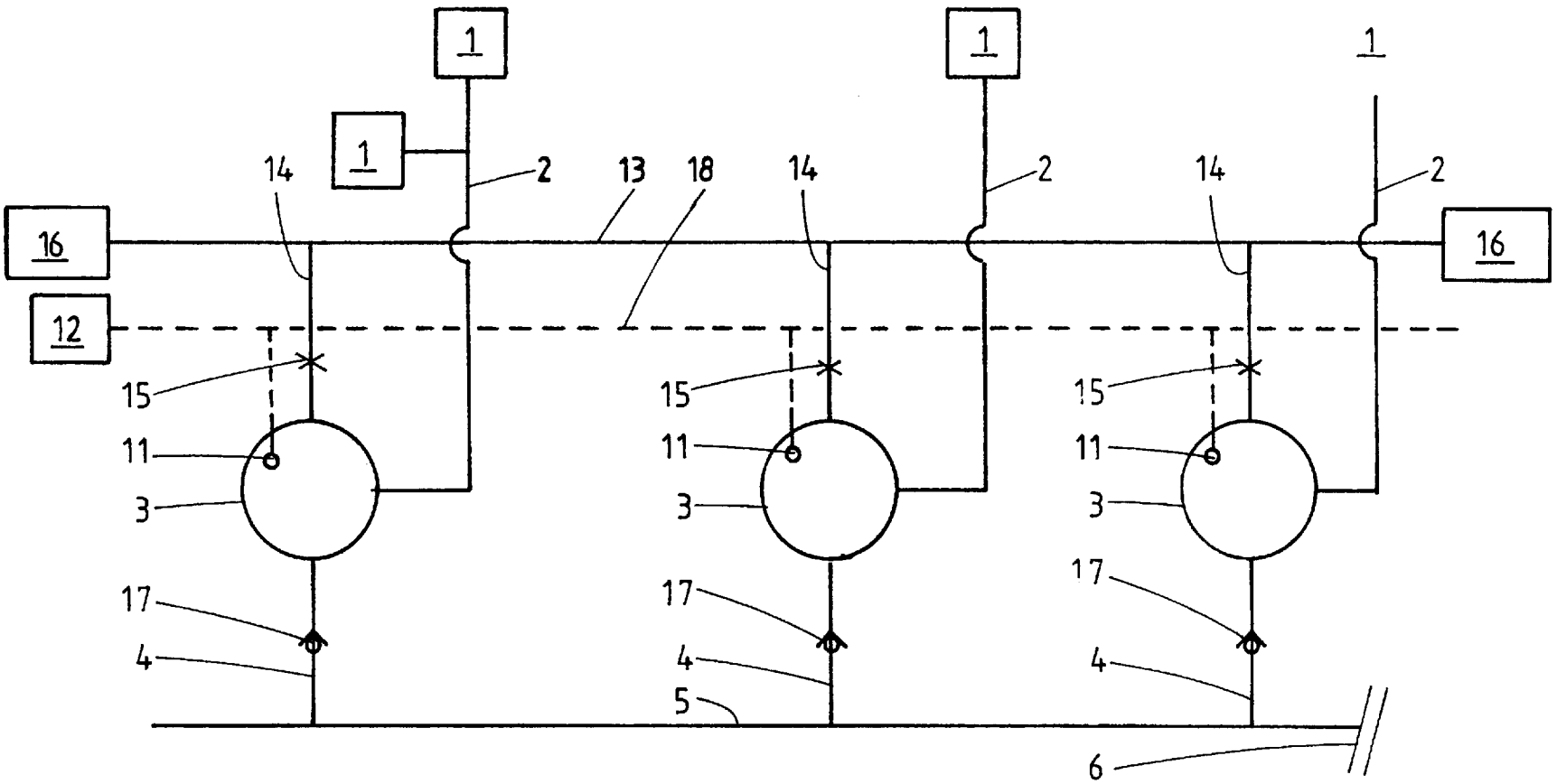
FIG. 1 is a diagrammatic a plan view of one embodiment of the sewage system according to the invention.

FIG. 1 diagrammatically shows a number of houses or other types of buildings or sewage connections 1 comprising a supply pipe 2, with one or more of said sewage connections being connected to a collecting space 3. At the discharge end each collecting space 3 is connected, via a connecting pipe 4 fitted with a non-return valve 17, to a common discharge pipe 5, which connects collecting spaces 3 with one another. Discharge pipe 5 may be closed at one end, or be connected to one of the collecting spaces 3, and be connected at its other end to a sewage pipe 6 having a larger diameter, or to another discharge point. Alternatively discharge pipe 5 may comprise a discharge point at another location, or even comprise several discharge points.

Figure 2:
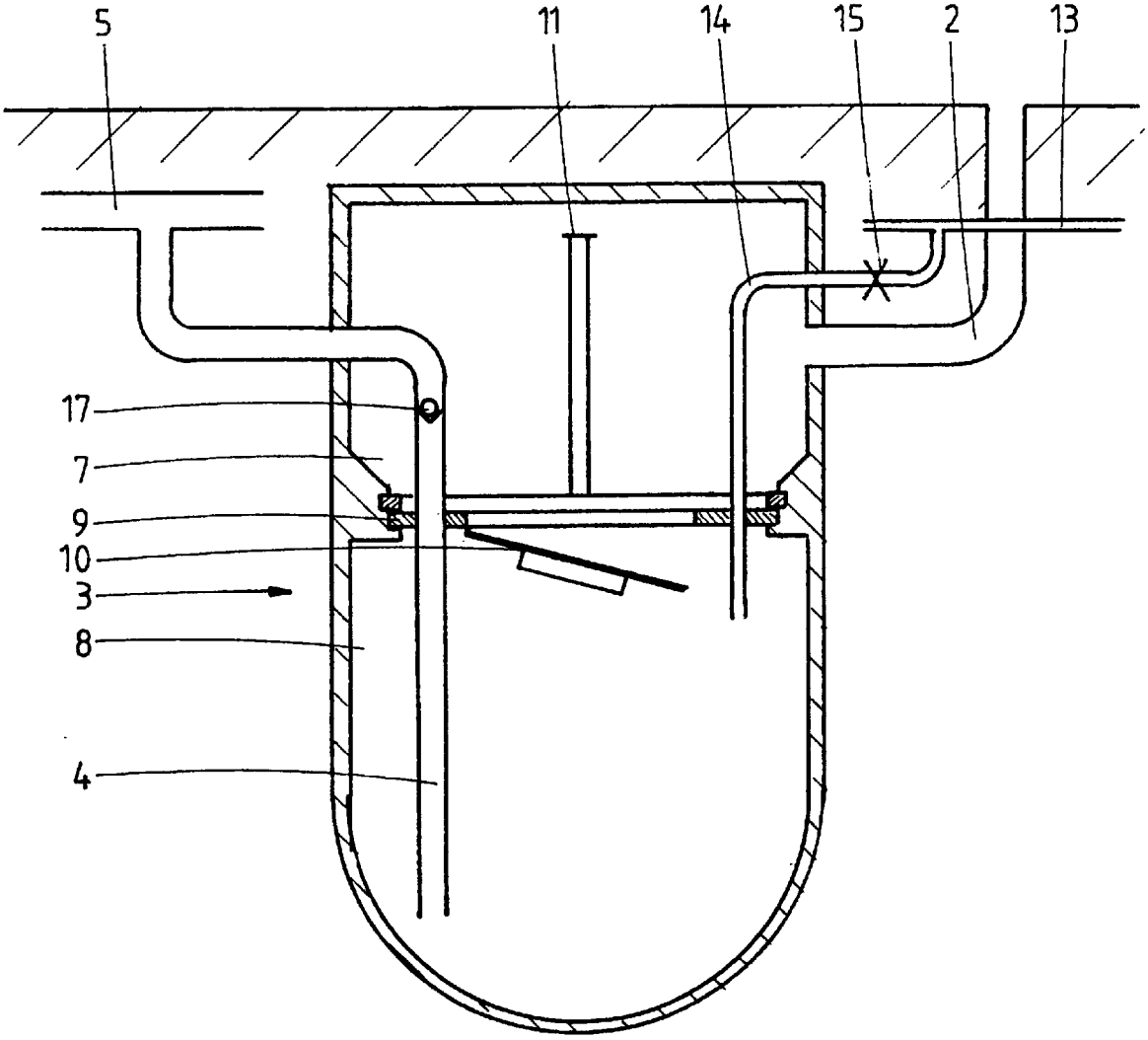
FIG. 2 is a larger-scale, schematic vertical section of one of the collecting spaces of the sewage system of FIG. 1.

As FIG. 2 shows, each collecting space 3 includes an upper space 7, to which supply pipe 2 is connected, and a lower space 8, which is in communication with discharge pipe 5 via connecting pipe 4. Upper and lower spaces 7, 8, whose respective capacities are in the proportion of 1:1 or 1:2, for example, are separated from each other by a partition 9 comprising a valve 10, a self-closing valve in this case. This implies that sewage water flowing into collecting space 3 can flow from upper space 7 to lower space 8, via connecting pipe 2, until lower space 8 is filled, after which valve 10 will close and upper space 7 will be filled. Present in upper space 7 is a level gauge or level switch 11, by means of which a signal can be delivered to a control system 12 to indicate that a collecting space 3 is filled to a level which requires emptying. A cable 18 for control system 12 can be laid simultaneously with the installation of the sewage system, via which cable the communication between a central control unit and signalling and warning means and elements to be operated in the various collecting spaces 3 takes place.

A pressure pipe 13 to be used in the emptying of collecting spaces 3 has been installed, which pressure pipe is connected by means of connecting pipes 14 to the various collecting spaces 3, and that to the lower spaces 8 thereof. In the present case an air valve 15 is incorporated in each connecting pipe 14, which valve can selectively open or close connecting pipe 14 for selectively placing a collecting space 3 into communication with pressure pipe 13 for the purpose of emptying said collecting space. The pressure in pressure pipe 13 is generated by means of one or more compressed air sources 16, such as an air compressor, which are disposed at a selected advantageous location.

From the arrangement shown in the Figure it will be apparent that collecting spaces 3 are interconnected in parallel relative to discharge pipe 5 and pressure pipe 13. This makes it possible to respectively empty only one collecting space or a group of collecting spaces.

A practical embodiment of the collecting space and the connections is an embodiment wherein connecting pipe 4 of discharge pipe 5 and connecting pipe 14 of pressure pipe 14 enter collecting space 3 through the wall of upper space 7 at a relatively high level, from which they extend to lower space 8 via partition 9. Partition 9 may thereby be provided with a plate fitted in a seat of collecting space 3, in which plate valve 10 is incorporated. An annular area surrounding valve 10 may be used for sealingly passing connecting pipes 4 and 14 therethrough. The plate may be retained in the seat by means of a large spring washer. This manner of connecting makes it easier to build collecting space 3, which is configured as a catch pit, into the ground, since the connections are located near the upper side of collecting space 3, running internally from the collecting space to the desired level.

The operation of the sewage system is as follows. Collecting spaces 3 are gradually filled, whereby one collecting space may fill more quickly than the other. When the level gauge 11 present in the upper space of one collecting space 3 indicates that the predetermined level has been reached, a signal will be transmitted to control system via cable 18. The control system responds to said signal by delivering a control signal to air valve 15 of the collecting space 3 in question, as a result of which said air valve 15 will open. As a result of this the pressure prevailing in pressure pipe 13, which is maintained or generated by pressure source 16, is admitted into lower space 8 of said collecting space 3. This results in the pressurization of the lower space 8 closed by valve 10, and sewage water present therein will be forced to discharge pipe 5 via the non-return valve 17 present in connecting pipe 4, which has been opened by said pressure. Discharge pipe 5 carries the sewage water to discharge point 6. The sewage water or the compressed air cannot enter the other collecting spaces 3 thereby, due to the fact that the non-return valves thereof are closed. When air valve 15 is closed again, the pressure in lower space 8 will fall and valve 10 in partition wall 9 will be opened by the weight of the water present in upper space 7, and water can flow from upper space 7 into lower space 8. Valve 10 remains opened until lower space 8 is filled again.

From the foregoing it will be apparent that the invention provides an adequately, efficiently and reliably operating waste water disposal system. The invention is not limited to the embodiment which has been described above and which is illustrated in the drawing, to which several variations are possible within the scope of the invention. Thus the invention may also be used with a combined sewage system. Furthermore the invention may be used with various other types of waste water disposal systems. It is also possible to incorporate not one but several collecting spaces within one branch of the parallel arrangement of collecting spaces, which will form a series arrangement circuit in that case.

What is claimed is:

1. A waste water disposal system comprising a plurality of collecting containers (3) each divided into a lower space (8) and an upper space (7), said lower and upper spaces (8, 7) are separated by a partition (9) comprising a valve member (10) therein, waste water connections (1) connected to the upper spaces (7) of the plurality of collecting containers (3) via supply pipes (2), a discharge pipe (5) connected to the lower spaces (8) of said collecting containers (3) via connecting pipes (4), a pressure pipe (13), a compressed air source (16) connected to said collecting containers (3) via connecting pipes (14), and a control system (12) for selectively emptying said collecting containers (3) into the discharge pipe (5) by introducing compressed air into the lower spaces (8) of the collecting containers (3) via said pressure pipe (13), wherein the pressure pipe (13) and the discharge pipe (5) are separate pipes, the collecting containers (3) are interconnected in parallel between the pressure pipe (13) and the discharge pipe (5) via the connecting pipes (4, 14), the connecting pipe (4) of the discharge pipe (5) of each collecting container (3) runs upwardly from a level near the bottom of said collecting container (3) and is connected to discharge pipe (5) at a higher level, and the compressed air source (16) is connected to provide compressed air simultaneously to all connecting pipes (14) to force the waste water through the connecting pipes (4) and through the discharge pipe (5).

2. A waste water disposal system according to claim 1, wherein said connecting pipes (4, 14) for the pipes (5, 13) run upwardly from a level near the bottom of the collecting container to a desired level and the connections for connecting said connecting pipes (4, 14) to said pipes (5, 13) are located near the upper side of said collecting container.

3. A waste water disposal system according to claim 1 further comprising a non-return valve (17) incorporated in the connecting pipe between each collecting container (3) and the discharge pipe (5), which non-return valve closes in the direction of the collecting container.

4. A waste water disposal system according to claim 1, comprising at least one air valve (15) between one or more collecting containers (3) for selectively placing the pressure in the pressure pipe (13) into communication with the collecting containers (3).

5. A waste water disposal system according to claim 4, wherein each collecting container (3) is provided with an air valve (15) in the connecting pipe (14) on the side of the pressure pipe (13), which air valve is connected to the control system (12).

6. A waste water disposal system according to claim 4, wherein the control system (12) is arranged for individually operating the various air valves (15).

7. A waste water disposal system according to claim 1, wherein each collecting container (3) is provided with a level gauge (11) connected to the control system (12).

8. A waste water disposal system according to claim 1, wherein a number of compressed air sources (16) are connected to the pressure pipe (13) at different locations.

9. A waste water disposal system according to claim 1 wherein said discharge pipe (5) comprises a number of discharge points (6).

10. A waste water disposal system according to claim 1, wherein each collecting container (3) comprises a backflow arrangement.

11. A waste water disposal system according to claim 1, wherein said discharge pipe (5) and said pressure pipe (13) are connected to said lower space (8) via said partition (9), entering the collecting container (3) at a high level through the wall of said upper space (7).

* * * * *